US006857989B2

(12) United States Patent
Mosley et al.

(10) Patent No.: US 6,857,989 B2
(45) Date of Patent: Feb. 22, 2005

(54) TREADMILL INCLUDING A MOTOR HAVING AN OUTER ROTOR

(75) Inventors: Raymond A. Mosley, El Paso, TX (US); Rafael O. Maynez, El Paso, TX (US); Manuel Ramirez, Chih (MX)

(73) Assignee: A.O. Smith Corporation, Milwaukee, WI (US)

( * ) Notice: Subject to any disclaimer, the term of this patent is extended or adjusted under 35 U.S.C. 154(b) by 537 days.

(21) Appl. No.: 10/068,237

(22) Filed: Feb. 6, 2002

(65) Prior Publication Data

US 2002/0107113 A1 Aug. 8, 2002

Related U.S. Application Data

(60) Provisional application No. 60/267,047, filed on Feb. 7, 2001.

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 2,802,957 A 8/1957 Gievers
2,905,010 A 9/1959 Rieser
4,720,638 A 1/1988 Vollbrecht
4,724,346 A 2/1988 Klein et al.
4,771,197 A 9/1988 Ivanto et al.
5,476,430 A * 12/1995 Lee et al. ..... 482/54
5,509,872 A 4/1996 Chen
5,962,939 A 10/1999 Nakamura et al.
6,152,860 A 11/2000 Wang
6,455,960 B1 * 9/2002 Trago et al. ..... 310/64

* cited by examiner

*Primary Examiner*—Glenn Richman
(74) *Attorney, Agent, or Firm*—Michael Best & Friedrich LLP

(57) ABSTRACT

A treadmill including a frame, a power supply, and a motor coupled to the frame and to the power supply. The motor includes a shaft and a stator fixedly coupled to the frame, at least one bearing coupled to the shaft, and a rotor coupled to the at least one bearing. The rotor includes at least a portion that surrounds at least a portion of the stator. The treadmill further includes a walking-belt assembly coupled to the frame and to the rotor.

26 Claims, 8 Drawing Sheets

TREADMILL INCLUDING A MOTOR HAVING AN OUTER ROTOR

RELATED APPLICATIONS

This application claims the benefit of U.S. Provisional Application No. 60/267,047, entitled TREADMILL INCLUDING A MOTOR HAVING AN OUTER ROTOR, filed on Feb. 7, 2001.

BACKGROUND OF THE INVENTION

The invention relates to a treadmill including a motor having an outer rotor.

A treadmill 100 of the prior art is shown in FIG. 1. FIG. 2 shows a top-plan-sectional view of certain aspects of the treadmill 100. As shown in FIGS. 1 and 2, the prior-art treadmill 100 generally includes a frame 105, a walking-belt drive assembly 110, a motor assembly 115, and control circuitry 118.

The control circuitry 118 includes a motor power supply 120 and a treadmill controller 123. As best shown in FIG. 2, the motor power supply 120 is electrically connected to the motor assembly 115. The treadmill controller 123 includes an input device (e.g., an on/off switch, one or more buttons, a control dial, an entry keypad, etc.) that allows an operator to operate the treadmill 100. For the prior art embodiment shown, the input device is an on/off switch 125 (FIG. 1). When the on/off switch 125 is on, the motor power supply 120 controllably transmits a power to the motor assembly 115. In other embodiments of the invention, the treadmill controller 123 may include artificial intelligence (e.g., a microprocessor and a memory unit having a software program) that interacts with the motor assembly 115 for better controlling the treadmill 100.

The motor assembly 115 receives the electrical power from the motor power supply 120 and converts the power into mechanical power. The mechanical power is provided to the walking-belt drive assembly 110. As best shown in FIG. 2, the motor assembly 115 includes a motor 127 having a housing 128, first and second bearings mounted in the housing 128, a stator, a rotor, a shaft 130 and one or more fasteners 135. For the prior art treadmill motor 127, the stator is directly coupled to the housing 128 and includes a motor back iron and magnets. The rotor is encircled by the stator, is supported by the shaft and bearings, and rotates within the stator. When the motor 115 receives power from the motor power supply 120, a magnetic field is created by the inner rotor that interacts with a magnetic field generated by the stator magnets. The interacting magnetic fields cause the rotor and, consequently, the motor shaft 130 to rotate.

The fastener 135 couples the motor 127 to the frame 105 and prevents the stator, including the magnets and back iron, from moving. For the prior art embodiment shown, the fastener is a mounting base.

The prior art motor assembly 115 further includes a flywheel 140 directly mounted on the shaft 130 and located externally to the motor 127. The flywheel 140 includes a first pulley 145 directly coupled to the flywheel 140. The flywheel 140 provides a smoothing affect to the motor 127. In other words, if the load (i.e. the walking-belt drive assembly 110) attached to the first pulley 145 varies (i.e., a person is walking or running on the treadmill), then the flywheel 140 evens out the varying load. Specifically, the demand or load on the motor assembly 115 increases each time the operator's foot contacts the walking belt 160 (discussed below), resulting in the operator transferring his weight to his foot.

Due to the flywheel 140 having inertia, the flywheel 140 evens out the varying load.

As shown in FIG. 2, the walking-belt drive assembly 10 includes a pulley belt 150 movably coupled with the motor assembly 115, a first roller 155 rotatably mounted to the frame 105 and movably coupled to the pulley belt 150, a walking-belt 160 movably coupled to the first roller 155, a second pulley 157 directly coupled to the first roller 155, and a second roller (not shown) rotatably mounted to the frame 105 and movably coupled to the walking belt 160. Upon the motor assembly 115 causing the pulley belt 150 to move, the pulley belt 150 rotates the first roller 155. The rotation of the first roller 155 results in the walking belt 160 continuously rotating around the first and second rollers. This allows a user to walk or run on the walking belt 160. Of course, other conveyers or conveyer systems may be used in place of the first roller, second roller, and walking belt.

When a user is walking or running on the walking belt 160, a varying load (typically referred to as a "shock load") is introduced to the walking-belt drive assembly 110. Due to elements of the walking-belt drive assembly 110 interconnecting, the varying load is translated to the motor assembly 115 via the pulley belt 150.

As can be seen from FIGS. 1 and 2 and the description above, the treadmill 100 of the prior art includes a motor 127 having a rotor mounted on a shaft and being encircled by the stator. Furthermore, the prior art treadmill 100 includes a shockload-smoothing flywheel 140 located external to the motor 127 and coupled to the shaft 130 of the motor 127. It would be beneficial to eliminate or combine the flywheel with the motor 127 to reduce the number of parts of the motor assembly 115.

SUMMARY OF THE INVENTION

Accordingly, one embodiment of the invention provides a treadmill including a frame, a power supply, and a motor coupled to the power supply. The motor includes a shaft and a stator fixedly coupled to the frame, at least one bearing coupled to the shaft, and a rotor coupled to the at least one bearing. The rotor includes a portion that surrounds at least a portion of the stator. The treadmill further includes a conveyer coupled to the frame and to the rotor. The conveyer is driven at a rotational speed that is different than a rotational speed of the rotor.

In another embodiment, the invention provides a treadmill having a frame, a control circuitry including a power source, and a motor coupled to the control circuitry. The motor includes a shaft and a stator fixedly coupled to the frame, a rotor having at least a portion that surrounds at least a portion of the stator, and a first pulley coupled to the rotor. The treadmill further includes a first belt coupled to the first pulley, and a conveyer having a second pulley coupled to the first belt.

Other features and advantages of the invention will become apparent to those skilled in the art upon review of the following detailed description, claims, and drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including" and "comprising" and variations thereof herein is meant to encompass the items listed thereafter and equivalents thereof as well as additional items.

Figure 1:
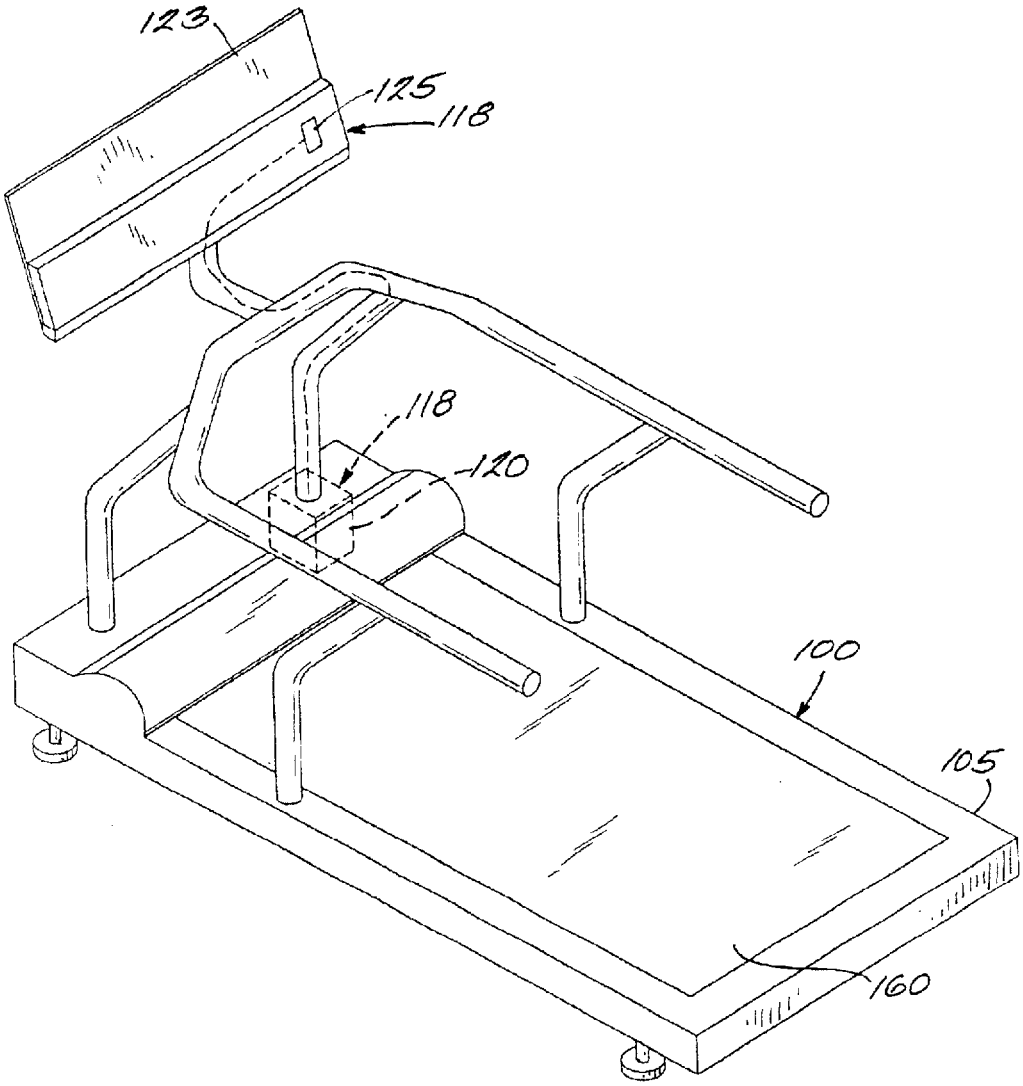
PRIOR ART Fig. 1
FIG. 1 is a perspective view of a treadmill of the prior art.
Figure 2:
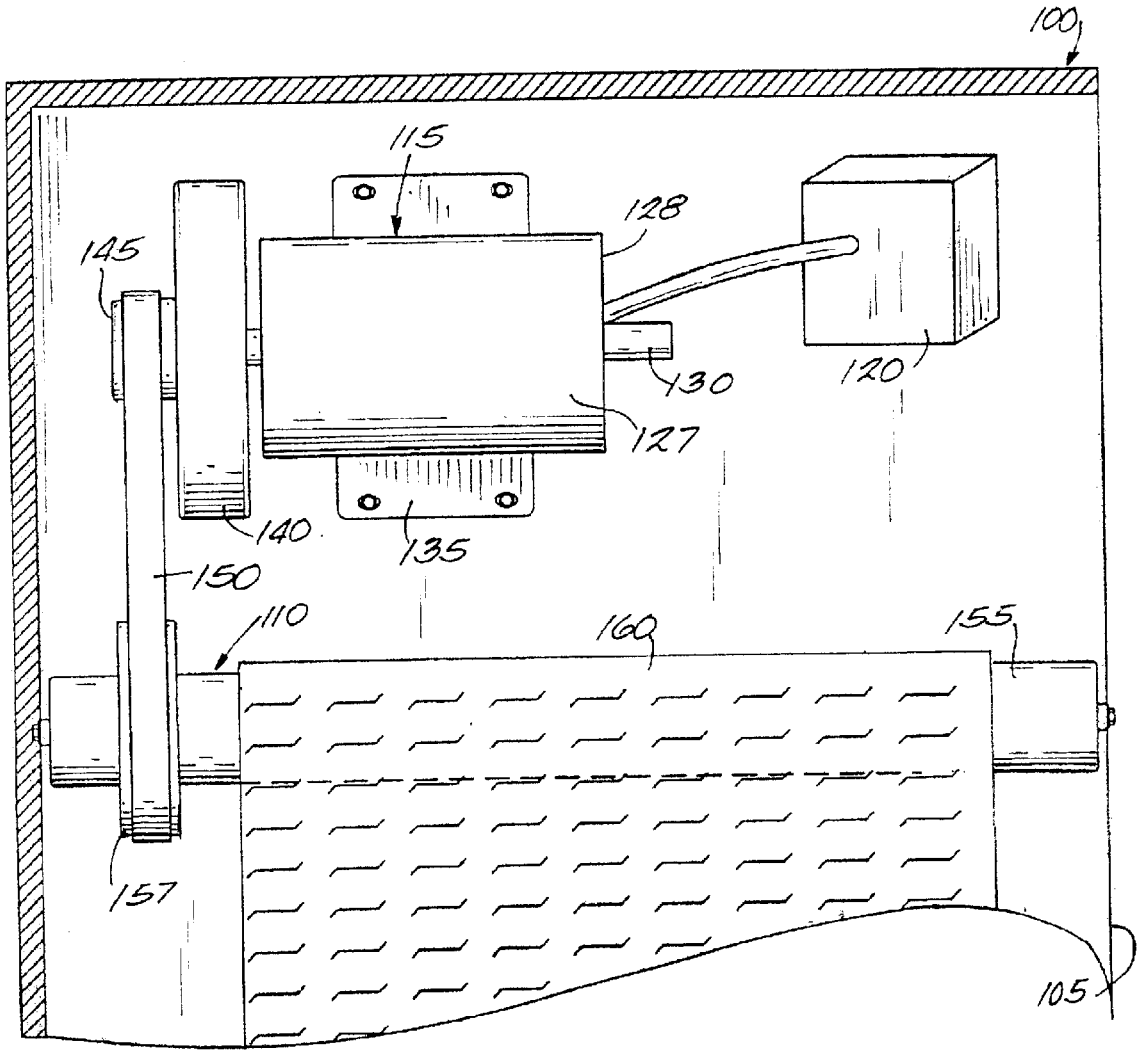
PRIOR ART Fig. 2
FIG. 2 is a top-plan-sectional view of a treadmill of the prior art.
Figure 3:
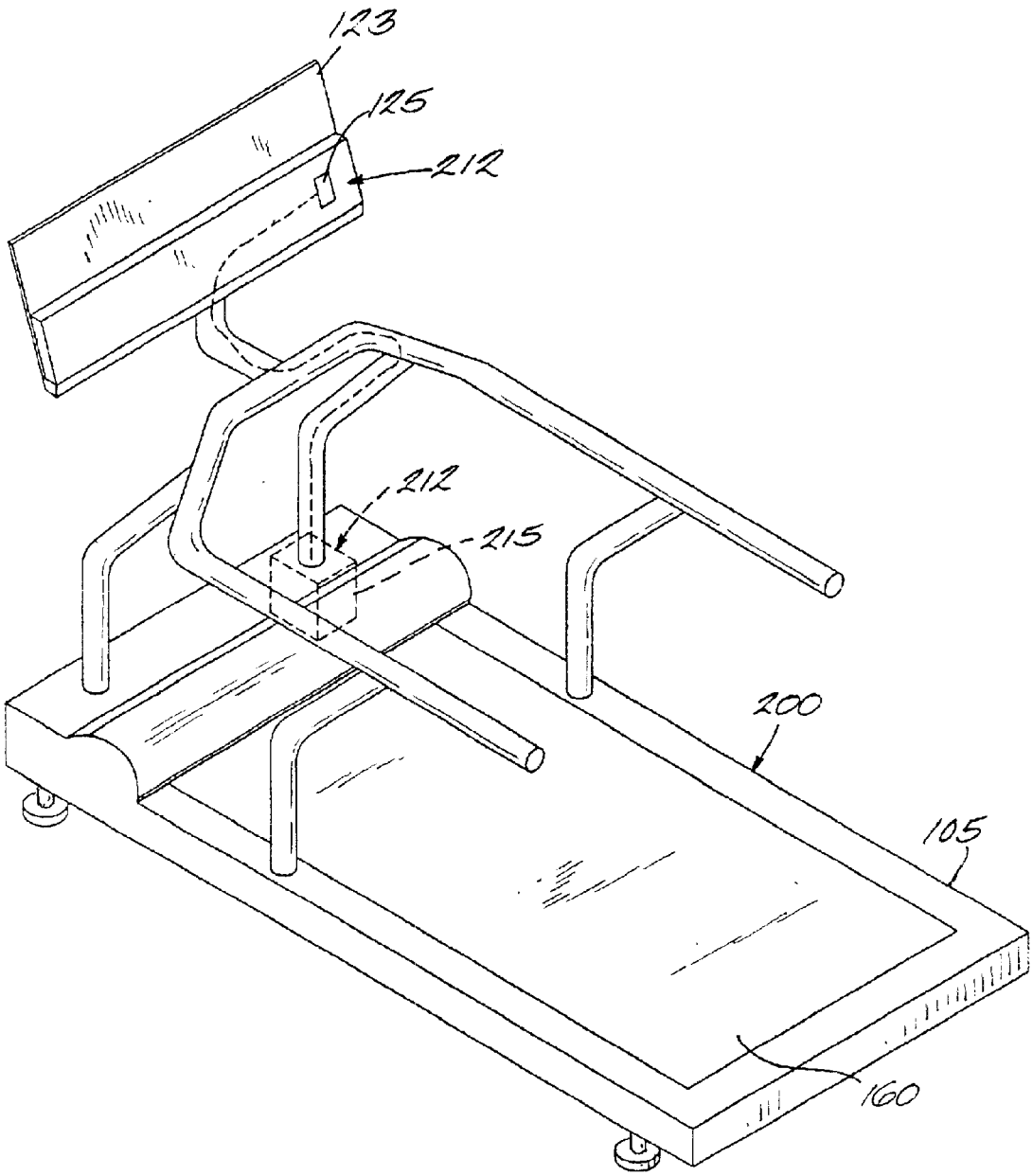
FIG. 3 is a perspective view of a first treadmill embodying the invention.
Figure 4:
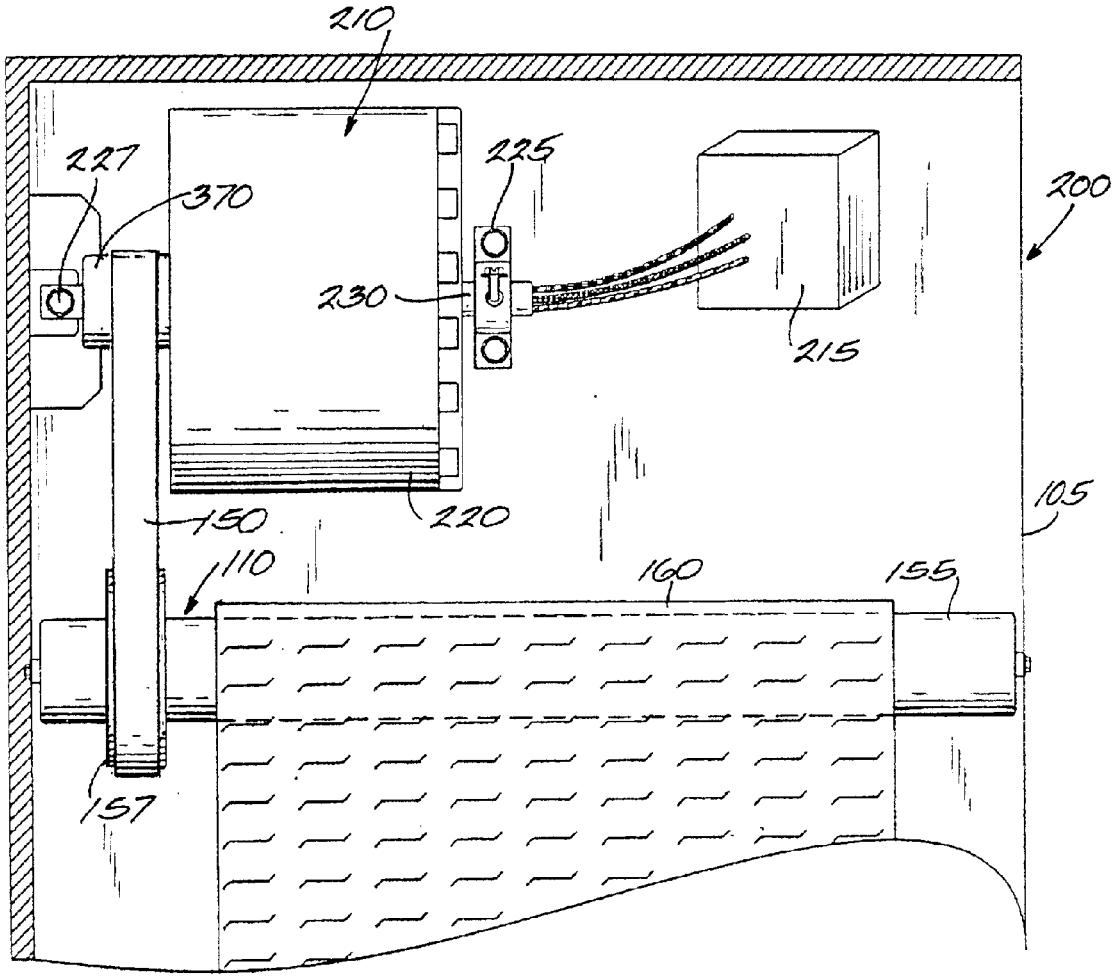
FIG. 4 is a top-plan-sectional view of a first treadmill embodying the invention.

A treadmill 200 of the invention is shown in FIG. 3. FIG. 4 shows a top-plan-sectional view of certain aspects of the treadmill 200. As shown in FIGS. 3 and 4, the treadmill 200 generally includes a frame 105, a walking-belt drive assembly 110, a motor assembly 210, and control circuitry 212. Some aspects of the treadmill 200 are similar to the treadmill 100 and are numbered with the same reference numerals. For example, the walking-belt drive assembly 110 of treadmill 200 is similar to the walking-belt drive assembly 110 of the treadmill 100.

The control circuitry 212 includes a motor power supply 215 and a treadmill controller 123. As best shown in FIG. 4, the motor power supply 215 is electrically coupled to the motor assembly 210. The motor power supply 215 includes a motor controller that controls the operation of a motor 220 (discussed below) of the motor assembly 210. For one embodiment of the invention, the motor controller is an Advanced Motion Controls—Brushless Servo Amplifier. The treadmill controller 123 includes an input device 125 (FIG. 3), which may be similar to the input device 125 (e.g., an on/off switch) of the prior art treadmill 100. When an operator moves the on/off switch 125 to the on position, the motor power supply 215 controllably transmits a power to the motor assembly 210. Of course, other input devices may be used.

One motor assembly 210 of the invention is shown in FIG. 4. The motor assembly 210 receives the electrical power from the power supply 215 and converts the power into mechanical power. The mechanical power is provided to the walking-belt drive assembly 110. The motor assembly 210 includes a motor 220, and one or more fasteners 225 and 227 that retain the motor 220. For the embodiment shown, the motor 220 is a DC-brushless motor with an outer rotor. However, other outer-rotor motors may be used. For the embodiment shown, the one or more fasteners are a clamp 225 and a bolt 227. Of course, other fasteners may be used such as rivets, clamps, or even an epoxy or glue. The one or more fasteners 225 and 227 hold and prevent a motor shaft 230 (discussed below) from moving. Thus, unlike the motor shafts of prior art treadmills, the motor shaft 230 is stationary at all times.

Figure 5:
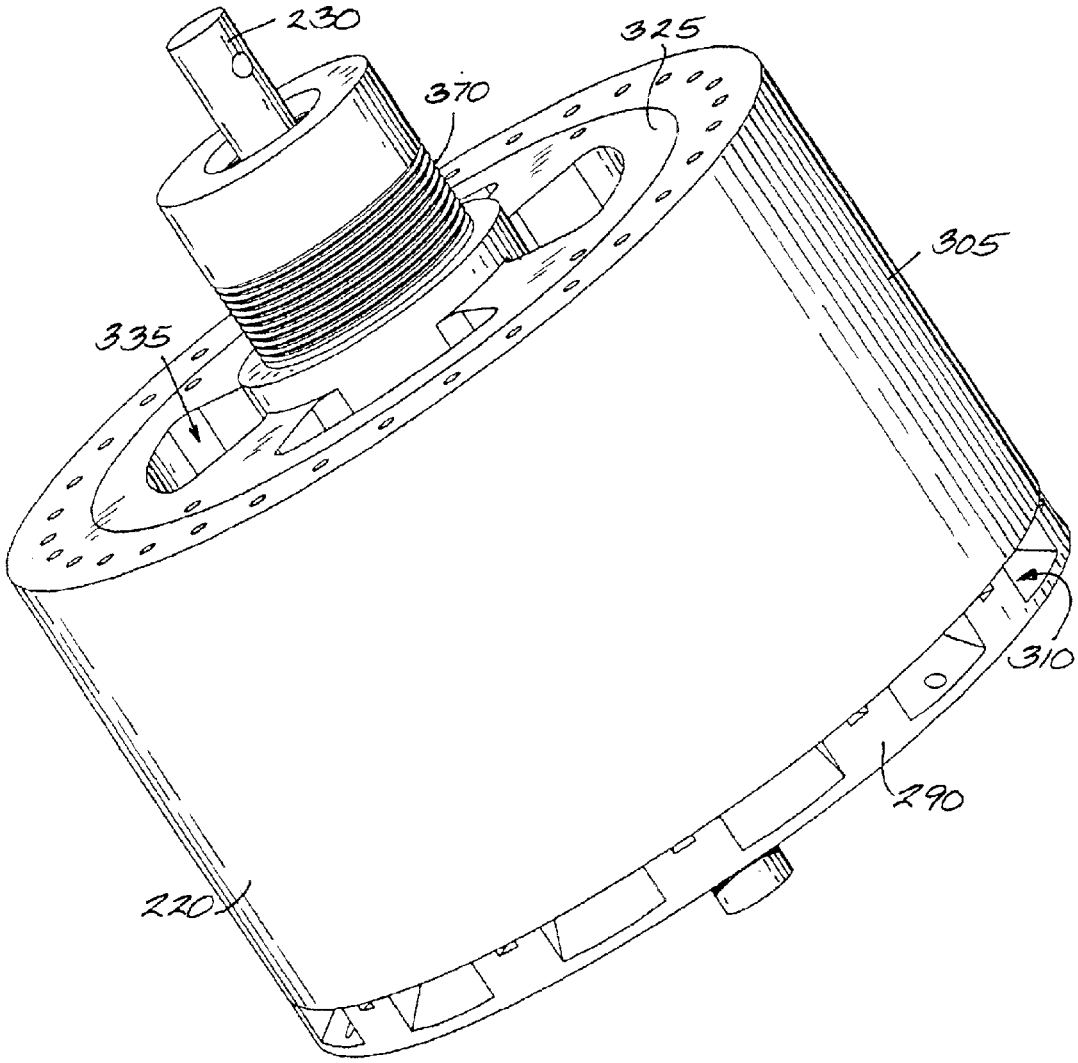
FIG. 5 is a perspective view of a direct-current motor capable of being used with a treadmill embodying the invention.
Figure 6:
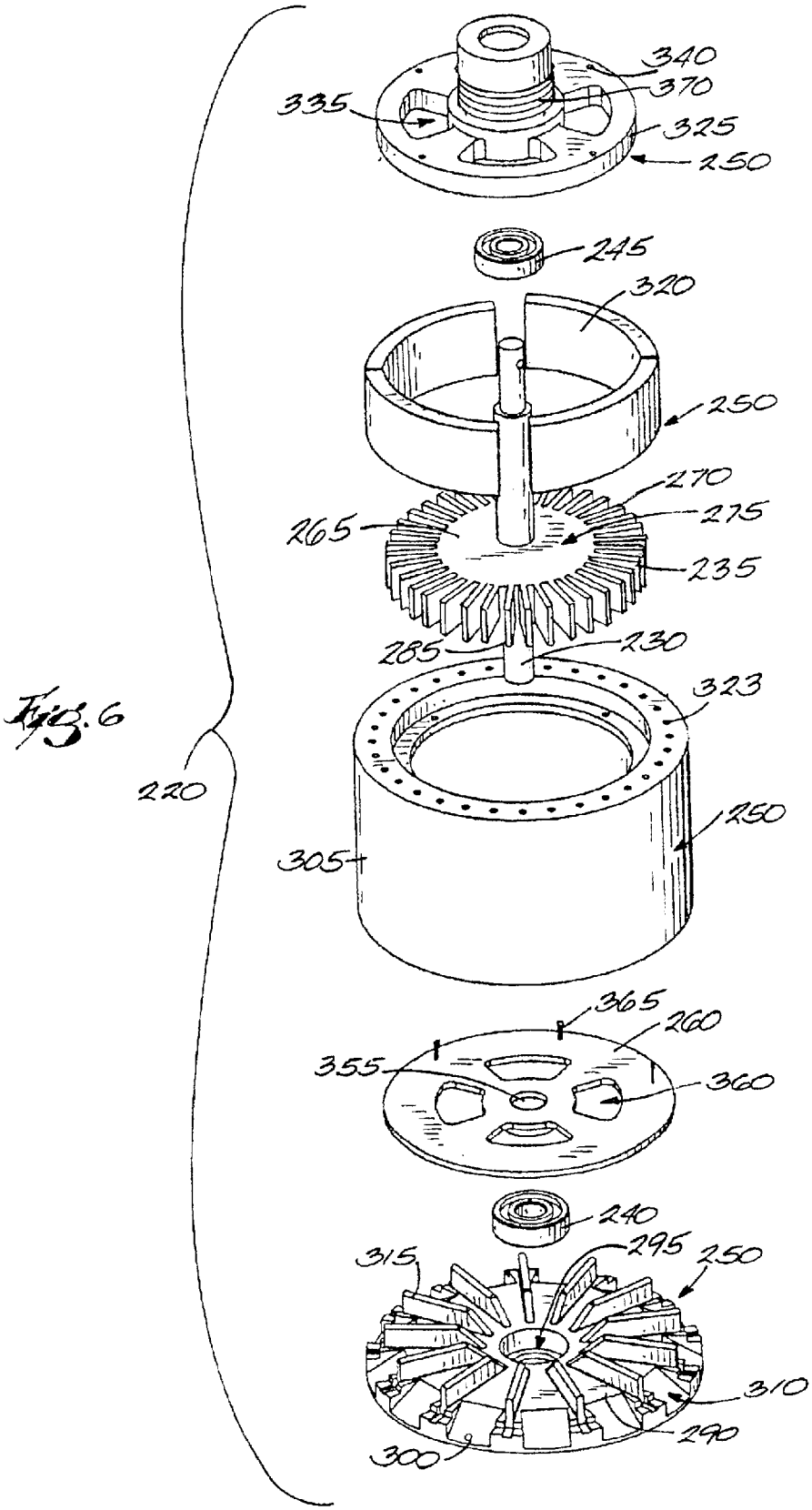
FIG. 6 is an exploded view of a direct-current motor capable of being used with a treadmill embodying the invention.

The motor 220 is shown in perspective view FIG. 5 and in exploded view FIG. 6. As shown in FIG. 6, the motor 220 includes a stator 235, first and second bearings 240 and 245, a rotor 250, and a sensor disk 260. The stator 235 includes the shaft 230 and a stator core 265 directly coupled to the shaft 230. The stator core 265 includes a plurality of teeth 270 forming a plurality of slots 275. The slots 275 receive one or more wire windings wound around the teeth 270 forming a plurality of coils. When power is provided to the windings, the coils create a plurality of magnetic poles or fields that interact with the rotor 250. The stator core 265 is made of a permeable magnetic material and has a central aperture that receives the motor shaft 230. The stator core 265 is fixed to the motor shaft 230 resulting in the stator 235 remaining stationary. In one embodiment of the invention, the stator core 265 includes a plurality of laminations 285 held by one or more fasteners. Alternatively, the stator core 265 may be a solid core.

The rotor 250 includes a first endbell or endplate 290 having a central aperture 295 that receives the first bearing 240. The first endplate 290 further includes apertures 300 that receive one or more fasteners (not shown) to secure the first endplate 290 to a back iron 305, and recesses 310 for allowing air to exit the motor 220. The first bearing 240 receives the shaft 230, which is secured by the one or more fasteners 225 and 227 (FIG. 4). Since the shaft 230 is secured, the first bearing 240 allows the first endplate 290 to rotate around the shaft 230. The first endplate 290 may include fins 315 that promote air movement through the motor 220 for cooling the motor 220.

The rotor 250 further includes a plurality of permanent magnets 320 fastened (e.g., glued) to the permeable magnetic metal back iron 305. The permanent magnets 320 produce a magnetic field that interacts with the magnetic poles created by the stator windings. The motor power supply 215 controls the power or current provided to the motor 220 resulting in the rotor 250 rotating around the stator 235. The back iron 305 includes a plurality of apertures that receive one or more fasteners (e.g., a plurality of bolts) for securing the first endplate 290 to the back iron 305.

The rotor 250 further includes a second endplate 325 having a central aperture for receiving the second bearing 245 and a plurality of air slots 335 for receiving air. The second bearing 245 is directly coupled to the shaft 230 allowing the second endplate 325 to rotate around the stator 235. Additionally, the second endplate 325 includes a plurality of apertures 340 that receive one or more fasteners for securing the second endplate 325 to the rotor 250. In another embodiment of the invention, the back iron 305 of the rotor 250 and the second endplate 325 are formed as a unitary piece.

For the embodiment shown in FIGS. 4–6, the second endplate 325 includes a first pulley 370 that receives the pulley belt 150 (FIG. 4) of the walking-belt drive assembly 110 (FIG. 4). By including the first and second pulleys 370 and 157 and the pulley belt 150, the speed of the motor 220 may be higher than the speed of the roller 155. A higher motor speed allows for more airflow through the motor 220 to remove heat from the motor 220. Removing more heat allows the motor assembly 210 to produce more torque. In addition, a greater motor speed provides more horsepower for the treadmill 200. Lastly, a greater motor speed results in the back iron 305 storing more energy and, thus, the kinetic energy of the rotating parts increases.

It is envisioned that other power-transmission assemblies may be used in place of the shown pulley-and-belt assembly (i.e., pulleys 157 and 370 and belt 150) for drivably connecting the motor 220 to the roller 155. Each power-transmission assembly functions to transmit rotational force of the rotor 250 to the roller 155. These alternative assemblies can employ one or more sprockets, drums, pulleys, wheels, and other rotating elements, which mesh together about a belt, chain, cable, or other such element.

Figure 7:
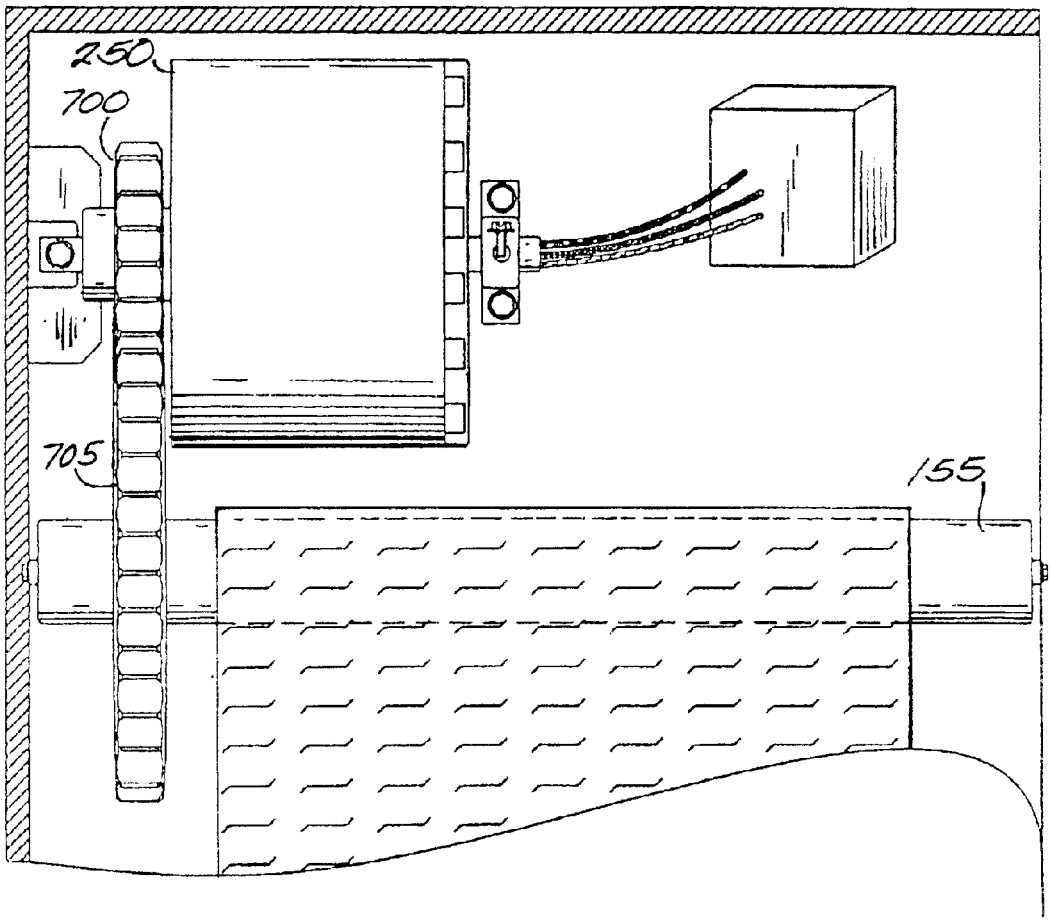
FIG. 7 is a top-plan-sectional view of a second treadmill embodying the invention.

For example, in one embodiment, the power-transmission assembly includes a gear assembly having two or more gears. For a specific example and as shown in FIG. 7, a first gear 700 is coupled to the rotor 250, a second gear 705 is coupled to the roller 155, and the first and second gears 700 and 705 are interconnected.

Figure 8:
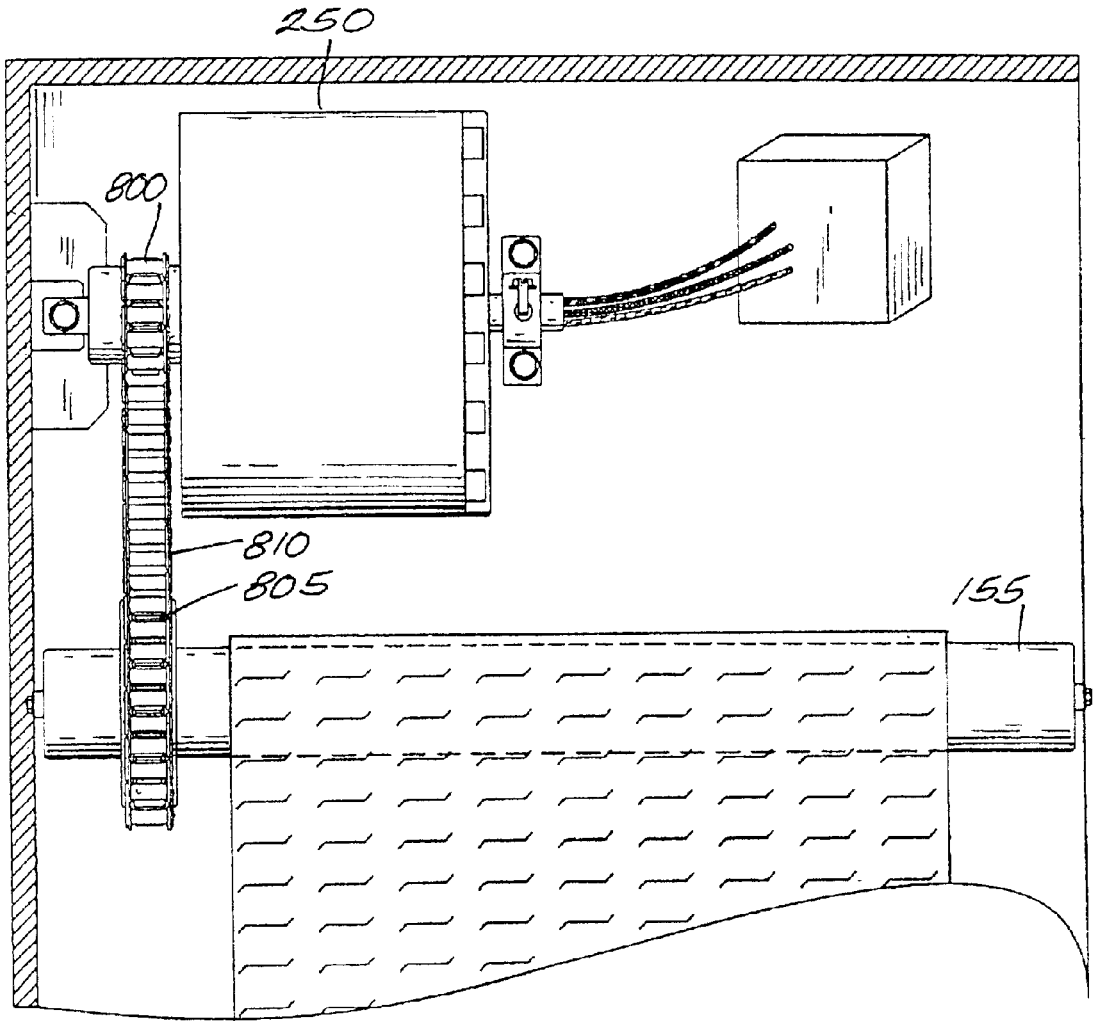
FIG. 8 is a top-plan-sectional view of a third treadmill embodying the invention.

In another embodiment, the power-transmission assembly is a sprocket-and-chain assembly. For a specific example and as shown in FIG. 8, a first sprocket 800 is coupled to the rotor 250, a second sprocket 805 is coupled to the roller 155, and a chain 810 couples the first and second sprockets 800 and 805. In yet other embodiments, a multiple-speed-transmission assembly is used. For example and with reference to FIG. 4, the belt-and-pulley assembly translates a first speed of the rotor 220 to a second speed at the roller 155. For a multiple-speed-transmission assembly consisting of belts and pulleys, an intermediate pulley (not shown) is used to translate the first speed of the rotor to an intermediate speed and, then, to translate the intermediate speed to the second speed at the roller 155.

The sensor disk 260 (FIG. 6) includes a central aperture 355, air slots 360, and sensors 365. The central aperture 355 receives the motor shaft 230 and is fixed to the motor shaft 230. The air slots 360 allow or promote air movement through the sensor disk 260. The sensors 365 sense an orientation or angular displacement of the rotor 250. For example, the sensors 365 may be Hall-effect sensors that sense the magnetic field of a plurality of permanent magnets 320 mounted in the rotor 250. The Hall-effect sensors produce one or more signals representing the physical location of the rotor 250 in response to the relationship of the magnetic poles with the Hall-effect sensors. The one or more location signals are transmitted back to the motor power supply 215. Based on the transmitted signals, the motor power supply 215 controls the operation of the motor 220. Of course, other sensors may be used.

Unlike the motor assembly 115 of prior art treadmills, the rotor 250 generates a significant amount of kinetic energy resulting in the motor assembly 210 not requiring a flywheel. In other words, because the rotor 250 is external to the stator 235 and since the back iron 305, magnets 320, and the first and second endplates 290 and 325 have a significant amount of mass, some of which may be superfluous or not required by the motor to operate, the kinetic energy produced by the rotor 250 is comparable to the prior art inner rotor and flywheel combination.

As can be seen from the above, the invention provides a treadmill having a motor with an outer rotor and a pulley. By having a motor with an outer rotor, the flywheel of the prior art treadmill may be removed. This reduces the number of parts for the treadmill. In addition, by coupling the pulley of the pulley/belt system with the outer rotor, the motor may obtain a higher torque output than without a pulley/belt system. Various features and advantages of the invention are set forth in the following claims.

What is claimed is:

1. A treadmill comprising:

a frame;

a power supply;

a motor coupled to the power supply, the motor including a shaft and a stator fixedly coupled to the frame, at least one bearing coupled to the shaft, and a rotor coupled to the at least one bearing, the rotor including a portion that surrounds at least a portion of the stator;

a conveyer coupled to the frame; and a power-transmission assembly coupling the rotor and the conveyer.

2. A treadmill as set forth in claim 1 wherein the shaft and stator are a unitary element.

3. A treadmill as set forth in claim 1 wherein the stator includes one or more wires that create a plurality of magnetic poles when the motor receives an electrical power, and wherein the rotor includes a plurality of magnets operable to magnetically interact with the plurality of magnetic poles, thereby causing rotation of the rotor.

4. A treadmill as set forth in claim 1 wherein the power-transmission assembly comprises a pulley-and-belt assembly having at least one pulley and at least one belt, the pulley-and-belt assembly coupling the rotor to the conveyer.

5. A treadmill as set forth in claim 4 wherein the pulley-and-belt assembly includes a first pulley coupled to the rotor, a second pulley coupled to the conveyer, and a belt coupled to the first and second pulleys.

6. A treadmill as set forth in claim 1 wherein the power-transmission assembly comprises a gear assembly having two or more gears, the gear assembly coupling the rotor to the conveyer.

7. A treadmill as set forth in claim 6 wherein the gear assembly includes a first gear coupled to the rotor and a second gear coupled to the conveyer, wherein the second gear is driven by the first gear.

8. A treadmill as set forth in claim 1 wherein the power-transmission assembly comprises a sprocket-and-chain assembly having at least one sprocket and at least one chain, the sprocket-and-chain assembly coupling the rotor to the conveyer.

9. A treadmill as set forth in claim 8 wherein the sprocket-and-chain assembly includes a first sprocket coupled to the rotor, a second sprocket coupled to the conveyer, and a chain coupling the first and second sprockets.

10. A treadmill as set forth in claim 1 wherein the power-transmission assembly comprises a multiple-speed-transmission assembly coupling the rotor to the conveyer.

11. A treadmill comprising:

a frame;

a power supply;

a motor coupled to the power supply, the motor including a shaft and a stator fixedly coupled to the frame, the stator including one or more wires that create a plurality of magnetic poles when the motor receives an electrical power, at least one bearing coupled to the shaft, and a rotor coupled to the at least one bearing, the rotor including a portion that surrounds at least a portion of the stator, a plurality of magnets operable to magnetically interact with the plurality of magnetic poles thereby causing rotation of the rotor, and a back iron, wherein the magnets are coupled to the back iron, and wherein the back iron includes a superfluous mass such that, when the rotor rotates, the superfluous mass produces kinetic energy for smoothing a shock load applied to the motor; and a conveyer coupled to the frame and to the rotor.

12. A treadmill as set forth in claim 11 wherein the back iron is a permeable-magnetic metal back iron.

13. A treadmill as set forth in claim 12 wherein the rotor further includes at least one endplate, wherein the at least one endplate includes a second superfluous mass such that, when the rotor rotates, the second superfluous mass produces additional kinetic energy for smoothing the shock-load.

14. A treadmill comprising:

a frame;

control circuitry including a power source;

a motor coupled to the control circuitry, the motor including a shaft and a stator fixedly coupled to the frame, a rotor having at least a portion that surrounds at least a portion of the stator; and a first pulley coupled to the rotor;

a first belt coupled to the first pulley; and a conveyer having a second pulley coupled to the first belt.

15. A treadmill as set forth in claim 14 wherein the control circuitry includes a controller.

16. A treadmill as set forth in claim 14 wherein the shaft and the stator form a unitary element.

17. A treadmill as set forth in claim 14 wherein the rotor includes the first pulley.

18. A treadmill as set forth in claim 14 wherein the conveyer is driven at a rotational speed that is different than a rotational speed of the rotor.

19. A treadmill as set forth in claim 14 wherein the motor further includes first and second bearings coupled to the shaft, and wherein the rotor is coupled to the bearings, thereby allowing the rotor to rotate.

20. A treadmill as set forth in claim 19 wherein the stator includes one or more wires that create a plurality of magnetic poles when the motor receives an electrical power, wherein the rotor includes a plurality of magnets operable to magnetically interact with the plurality of poles, thereby causing the rotation of the rotor.

21. A treadmill as set forth in claim 20, wherein the rotor further includes a back iron, wherein the magnets are coupled to the back iron, and wherein the back iron includes a superfluous mass such that, when the rotor rotates, the superfluous mass produces kinetic energy for smoothing a shock load applied to the motor.

22. A treadmill as set forth in claim 21 wherein the back iron is a permeable magnetic metal back iron.

23. A treadmill as set forth in claim 21 wherein the rotor further includes at least one endplate, wherein the at least one endplate includes a second superfluous mass such that, when the rotor rotates, the second superfluous mass produces additional kinetic energy for smoothing the shock load.

24. A treadmill comprising:

a frame;

a power supply;

a controller coupled to the frame and the power supply;

a motor coupled to the to power supply, the motor including a shaft and a stator fixedly coupled to the frame by at least one fastener, the stator including one or more wires that create a plurality of magnetic poles when the motor receives an electrical power from the power supply, first and second bearings coupled to the shaft, a rotor including a permeable magnetic back iron, a plurality of magnets coupled to the back iron, a first endplate coupled to the back iron and the first bearing, and a second endplate coupled to the back iron and the second bearing, wherein at least a portion of the back iron encircles at least a portion of the stator, and the back iron, first endplate and second endplate include a superfluous mass such that, when the rotor rotates, the superfluous mass produces additional kinetic energy for smoothing a shock load applied to the rotor, and a first pulley coupled to the rotor;

a first belt coupled to the first pulley;

a roller having a second pulley coupled to the first belt and being driven at a rotational speed that is different than a rotational speed of the rotor; and a second-belt coupled to the roller.

25. A treadmill as set forth in claim 24 wherein the rotor includes the first pulley.

26. A treadmill as set forth in claim 25 wherein the shaft and the stator form a unitary element.

* * * * *